United States Patent [19]

Theurer

[11] 4,090,451

[45] May 23, 1978

[54] MOBILE TRACK TAMPING MACHINE THAT TAMPS THREE SUCCESSIVE CRIBS

[75] Inventor: Josef Theurer, Vienna, Austria

[73] Assignee: Franz Plasser Bahnbaumaschinen-Industriegesellschaft m.b.H., Vienna, Austria

[21] Appl. No.: 652,476

[22] Filed: Jan. 26, 1976

[30] Foreign Application Priority Data

Feb. 27, 1975 Austria ..... 1537/75

[51] Int. Cl.[2] ..... E01B 27/16

[52] U.S. Cl. ..... 104/12; 104/10

[58] Field of Search ..... 104/12, 2, 7 R, 7 A, 104/7 B, 10, 11

[56] References Cited

U.S. PATENT DOCUMENTS

| | | | |
|---|---|---|---|
| 2,497,682 | 2/1950 | Mertz | 104/12 |
| 2,969,749 | 1/1961 | Plasser et al. | 104/12 |
| 3,380,395 | 4/1968 | Plasser et al. | 104/12 |
| 3,494,297 | 2/1970 | Plasser et al. | 104/7 B |
| 3,687,081 | 8/1972 | Plasser et al. | 104/12 |
| 3,717,100 | 2/1973 | Sieke et al. | 104/12 |
| 3,910,195 | 10/1975 | Theurer | 104/12 |
| 4,043,271 | 8/1977 | Theurer | 104/12 |

FOREIGN PATENT DOCUMENTS

| | | | |
|---|---|---|---|
| 1,709,433 | 3/1974 | Germany | 104/12 |
| 2,305,421 | 8/1974 | Germany | 104/12 |
| 2,460,700 | 7/1975 | Germany | 104/12 |

*Primary Examiner*—Drayton E. Hoffman
*Assistant Examiner*—Carl Rowold
*Attorney, Agent, or Firm*—Kurt Kelman

[57] ABSTRACT

A mobile track tamping machine comprises a tamping tool assembly mounted on a carrier for vertical movement therewith and a drive for vertically moving the tamping tool assembly carrier. The tamping tool assembly includes three pairs of vibratory tamping tools spaced from each other in the direction of track elongation so that the pairs of tools may be immersed in three successive cribs. The tools of each pair are reciprocable in opposite directions towards and away from the elongated edges of adjacent ties wherebetween the cribs are defined. All tamping tools are vibrated by a common drive and drives are provided for reciprocating the tamping tools.

8 Claims, 4 Drawing Figures

III
III

MOBILE TRACK TAMPING MACHINE THAT TAMPS THREE SUCCESSIVE CRIBS

The present invention relates to a mobile track tamping machine for substantially simultaneously tamping ballast underneath successive track ties resting on the ballast. Such ties have elongated edges extending transversely of the track and two ends extending in the direction of the track, the elongated edges of adjacent ones of the ties defining cribs therebetween.

Ever higher train speeds and heavy traffic tend to subject tracks and their ballast supports to ever increasing stresses, which requires increasingly frequent track surfacing and, on the other hand, shortens the dwell time available for the work of track surfacing machinery. It has been proposed to meet these requirements by using tamping machines which are capable of simultaneously tamping a plurality of ties, thus at least doubling the tamping efficiency. However, since the spacing between adjacent ties varies greatly, such multi-tie tamping machines have been difficult to operate and often required time-consuming adjustments during the intermittent advance of the machine to bring the tamping tools into proper alignment with the ties to be tamped.

In German Offenlegungsschrift (Published Application) No. 2,426,841, published Jan. 2, 1975, there is disclosed a mobile track tamping machine with two independently vertically movable tamping tool assemblies. Each tamping tool assembly includes a pair of vibratory tamping tools spaced from each other in the direction of the track so that each pair of tools is in vertical alignment with a respective one of two successive cribs, and a single tamping tool spaced from the pair of tools so that it is in vertical alignment with an adjacent crib whereby the tamping tools may be immersed in four cribs upon simultaneous vertical lowering of the tampering tool assemblies. Accurate observation of the immersion into four cribs is practically not possible so that the descending tamping tools will cause damage to any ties which, due to variations in tie spacing, lie in the path of the vertically moving tools. On the other hand, if the tamping tool assemblies are separately lowered, the work is delayed and the efficiency of the operation reduced.

U.S. Pat. No. 3,357,366, dated Dec. 12, 1967, discloses a tamper with a tamping assembly designed for the simultaneous tamping of two ties. These machines have had excellent success in track surfacing, in respect of work efficiency and quality, since it is easily possible to center the assembly so that the two intermediate tamping tools of the two pairs of tools are immersed in the crib defined between the two ties being tamped.

It is the primary object of this invention to provide a relatively simply constructed mobile track tamping machine for substantially simultaneously tamping ballast underneath more than two successive track ties resting on the ballast and which permits accurate centering of the tamping tools in the cribs.

This and other objects are accomplished in accordance with the invention with a tamping tool assembly including three pairs of vibratory tamping tools spaced from each other in the direction of the track, the spacing being such that each pair of tools is in vertical alignment with a respective one of three successive cribs whereby the tamping tools may be immersed in the cribs upon vertical lowering of the tamping tool assembly carrier. The tamping tools of each pair are reciprocable in opposite directions towards and away from a respective elongated edge of an adjacent tie. There is a drive for vertically moving the tamping tool assembly carrier, a common drive for vibrating the tamping tools and drive means for reciprocating the tamping tools.

The operator of such a track tamping machine may control the intermittent advancement of the machine from tamping station to tamping station, as well as the lowering of the tamping tool assembly carrier, essentially by observing the position of the intermediate pair of tamping tools in vertical alignment with a crib since this will assure a proper vertical alignment of the two other pairs of tamping tools with the adjacent cribs so that the descending tamping tools will not damage the ties between the cribs. Furthermore, three successive cribs may be observed relatively easily, as operators of the machine disclosed in the above-identified U.S. patent have learned, where the tamping tools are also immersed in three successive cribs. In addition, providing a common vibrating drive for all tamping tools has been found very advantageous since this subjects the entire tamped ballast under all the tamped ties to vibrations of the same frequency and amplitude, thus avoiding resonance phenomena in the ballast as well as in the machine frame.

The above and other objects, advantages and features of the present invention will become more apparent from the following detailed description of certain now preferred embodiments thereof, taken in conjunction with the generally schematic drawing wherein FIG. 1 is a side elevational view of a mobile track tamping machine according to one embodiment of this invention;

Figures 1, 2:
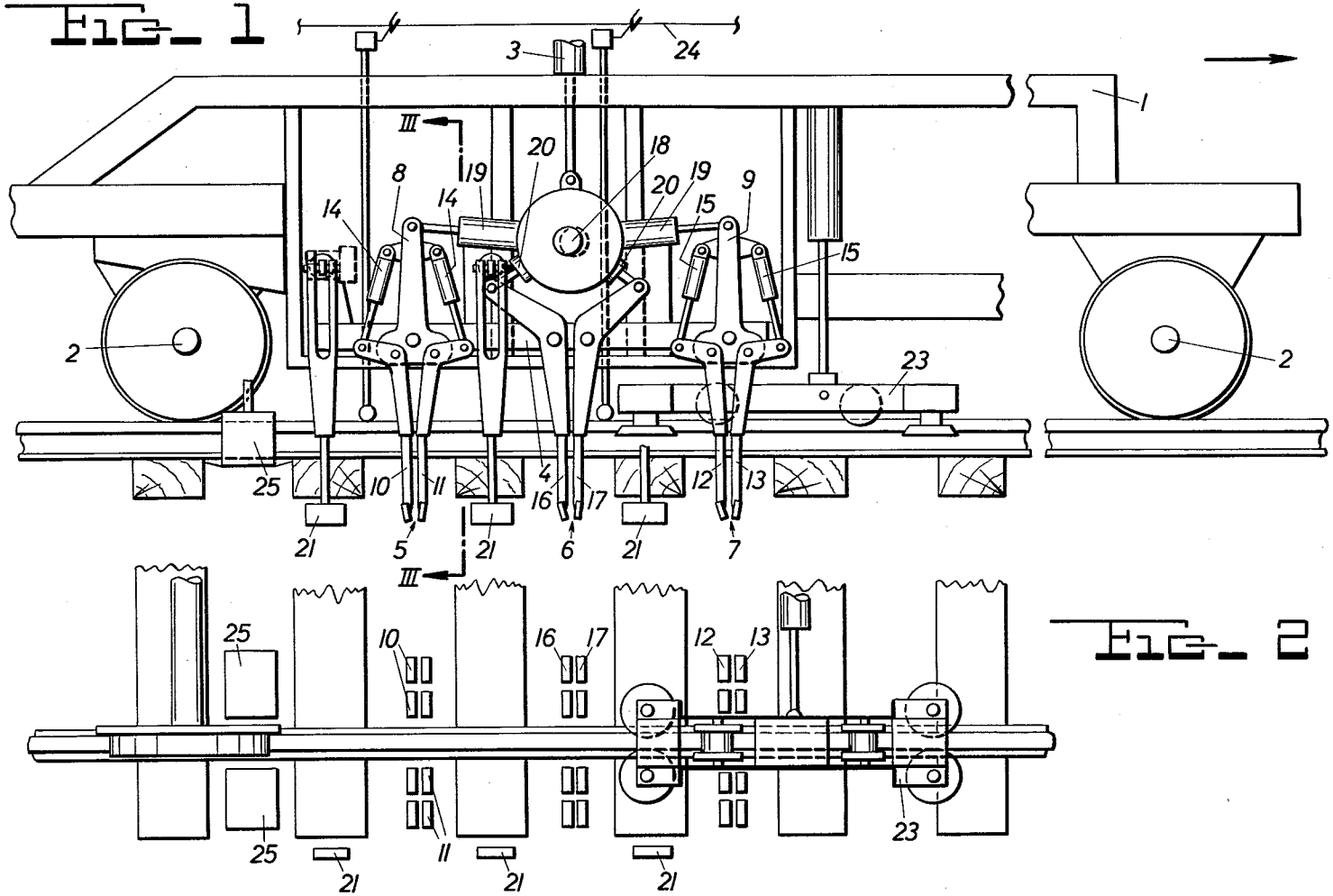
FIG. 2 is a partial top view on the track ties to be tamped by the machine of FIG. 1, the tamping tools and track lifting unit being schematically indicated.

Referring now to the drawing and first to FIG. 1, there is shown a mobile track tamping machine comprising machine frame 1 mounted for mobility on the track rails on under-carriages 2 for advancement in the direction of operation indicated by a horizontal arrow. Tamping tool assembly carrier 4 is vertically movably mounted on machine frame 1. The piston rod of hydraulic drive 3, whose cylinder is affixed to the machine frame, is connected to common vibrating drive 18 for vertically moving carrier 4.

A tamping tool assembly is mounted on the carrier for vertical movement therewith, the tamping tool assembly including an intermediate pair 6 of vibratory tamping tools and two other pairs 5 and 7 of vibratory tamping tools. The three pairs of tamping tools are so spaced from each other in the direction of the track that each pair of tools is in vertical alignment with a respective one of three successive cribs whereby the tamping tools may be immersed in the cribs upon vertical lowering of the tamping tool assembly carrier, as will be seen in FIG. 1. The tamping tools 10, 11 of pair 5, 16, 17 of pair 6 and 12, 13 of pair 7 are reciprocable in opposite directions towards and away from a respective longitudinal edge of the adjacent ties.

As will be seen from the drawing, common vibrating drive 18 for all the tamping tools is arranged above and in vertical alignment with intermediate pair 6 of tamping tools. This assures a centered load on this drive which is preferably hydraulically operated, as are all other drives. The illustrated drive 18 comprises an eccenter shaft rotated by a hydraulic motor and the centered position of the rotating shaft will reduce the wear on the shaft bearings and thus increase the operating life of the drive. The tamping tools of each pair are preferably vibrated in opposite directions, which will support the reciprocatory movement of the tools.

The illustrated tamping tools include tool holders in the shape of bell crank levers, each of the bell crank levers having an upwardly extending arm, a downwardly extending arm and a fulcrum therebetween. The fulcrums of tamping tools 16, 17 of the intermediate pair 6 are provided to carrier 4 while the fulcrums of tamping tools 10, 11 and 12, 13 of the two other pairs 5 and 7 are pivoted respectively to carrier frames 8 and 9 which, in turn, are pivotally mounted on carrier 4, the tamping tools and the carrier frames being pivotal about axes extending transversely of the track.

A respective hydraulic drive 20 links the upwardly extending arm of each tamping tool 16, 17 of intermediate pair 6 to vibrating drive 18 for reciprocating the tamping tools linked thereto and, at the same time, for transmitting vibrations from drive 18 to these tamping tools. Further hydraulic drives 19, 19 link each carrier frame 8, 9 to the vibrating drive for transmitting vibrations to the carrier frames and the tamping tools supported thereby.

Additional hydraulic drives 14 and 15 respectively link the upwardly extending arms of the tamping tool holders of tamping tools 10, 11 and 12, 13 to their carrier frames 8 and 9 for reciprocating these tamping tools. This independent reciprocation of the tamping tools of the outer pairs 5 and 7 of tamping tools increases the adaptability of the machine for use with different track constructions, for double ties, and the like, enabling the machine to be used for tamping only two successive ties, for instance, without any hindrance from the pair of tools not used.

As is known, the tamping effect will be improved by mounting additional vibratory tamping tools 21 on the tamping tool assembly for immersion in the ballast adjacent the ends of the ties and for reciprocation in a direction towards and away from the tie ends. These tamping tools are reciprocated by hydraulic drives 22 linking the upper ends of the tools to carrier 4 and preferably are also vibrated. In the illustrative embodiment, an additional tamping tool 21 is associated with each pair 5, 6 and 7 of tamping tools, and each additional tamping tool 21 is mounted behind the associated pair of tamping tools in the direction of machine operation.

As is conventional and only most schematically illustrated and briefly described, a track lifting and lining unit 23 is mounted in the region of the tamping tool assembly on machine frame 1 and engages the track rails with rollers to enable the track to be lifted and lined under the control of reference wire 24.

Figure 3:
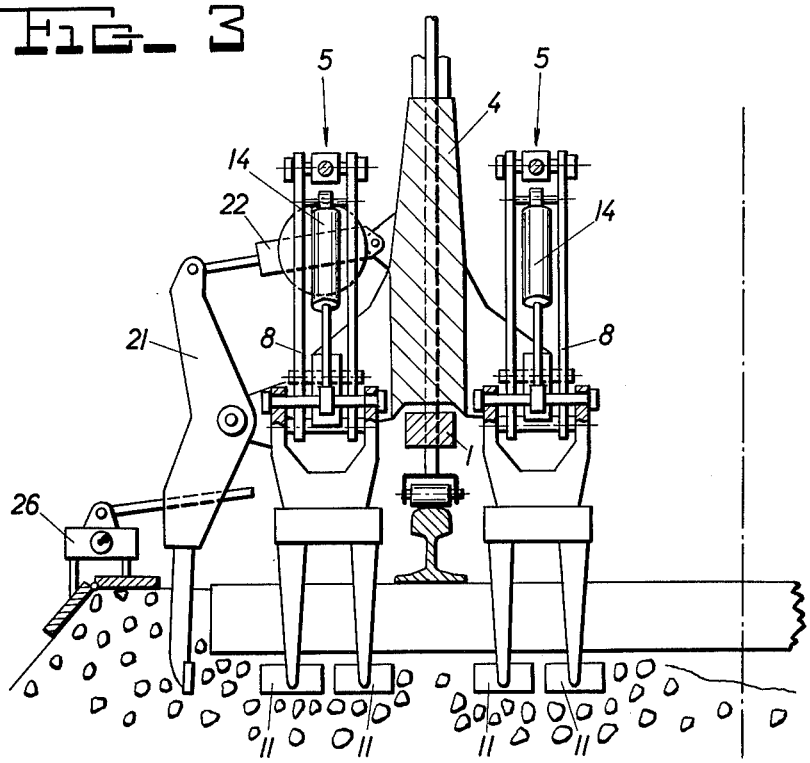
FIG. 3 is an end view of the tamping tool assembly, partly in section.

As will be seen from FIGS. 2 and 3, four tamping tools are associated with each rail along each elongated edge of a tie, i.e. each tamping tool holder carries a pair of tamping tools and a pair of such holders are mounted in transverse alignment, as will be seen in FIG. 3. However, any number of such tools may be used in transverse alignment, all transversely aligned tools functioning as a single one of the tamping tools of each pair.

As is also known per se, the quality of the ballast tamping will be further enhanced by arranging surface tampers 25 for compacting the ballast in the crib behind last pair 5 of the tamping tools in the direction of machine operation so as to finish the tamping operation in a single pass. Lateral displacement of the tamped ballast, for instance in a single-track right of way, will be further avoided by arranging a vibratory surface tamper 26 for compacting the ballast at the ballast bed slope and the ballast strip between the slope and the track.

Figure 4:
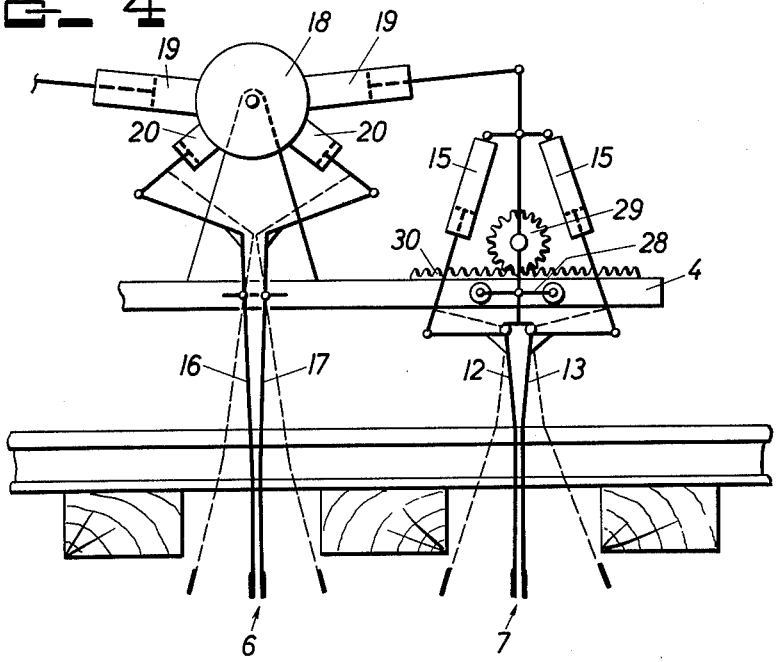
FIG. 4 is a very schematic side view of another embodiment of the tamping tool assembly.

The adaptability of the machine for use on tracks with varying tie spacings and the corresponding usefulness of the machine will be further increased by mounting at least one of the outer pairs 5 and 7 of tamping tools adjustably in relation to intermediate pair 6 in the direction of the track. Such an embodiment is shown in FIG. 4 which has been limited to an illustration of intermediate pair 6 and the outer pair 7 of tamping tools. All like reference numerals in this figure designate like parts operating in a like manner as in the above-described embodiment.

A guide 28 comprising rollers moving in rails on carrier 4 mounts on the carrier frame supporting tamping tools 12, 13 for movement in the direction of the track in relation to intermediate pair 6 of tamping tools 16, 17. The pair 7 of tamping tools is moved and held at an adjusted distance from intermediate pair 6 by a rack-and-pinion drive 29, 30, pinion 29 being driven by a hydraulic motor and rack 30 being affixed to carrier 4.

Three or four successive ties may be substantially simultaneously tamped with the above-described machine in the following manner:

When the tamping station has been reached, hydraulic motor 3 is operated to lower tamping tool assembly carrier 4 so as to immerse the pairs 5, 6 and 7 of tamping tools in three successive cribs and adjacent the ends of three successive ties, respectively. Vibrating drive 18 is operated to vibrate the tamping tools and hydraulic motors 14, 15 and 20 are operated to reciprocate tamping tools 10, 11, 16, 17, 12 and 13 against the elongated edges of the adjacent ties, thus tamping the ballast under the ties raised by lifting unit 23 under the combined action of vibration and lateral pressure.

As is conventional and, therefore, not illustrated, reciprocating drives 14, 15 and 20 are connected to a hydraulic fluid source, such as a constant-speed pump, by means of pressure relief valves which will operate to terminate the reciprocation of the tamping tools when a predetermined ballast density has been reached. Furthermore, the individual control of these reciprocating drives makes it possible to eliminate the reciprocation of one or both outer pairs 5, 7 of the tamping tools, if desired, so that ballast is tamped under only two ties.

With the embodiment of FIG. 4, it is further possible to adjust the spacing from the outer pairs of tamping tools to the intermediate pair if such spacing adjustment is required due to the varying spacing between the successive ties. The pinion-and-rack drive 29, 30 serves not only to move the pair of tamping tools but also to fix it in the adjusted position.

Small differences in tie spacings may be readily compensated merely by pivoting carrier frame 8 and/or 9 about its fulcrum by means of drive 19, thus slightly adjusting the longitudinal positioning of pair 5 and/or 7 of tamping tools in relation to pair 6.

While the common vibrating drive 18 for the tamping tools has been described and illustrated as a central eccenter shaft rotated by a hydraulic motor, other vibrating means may be used. It would be possible, for instance, to apply a pulsating hydraulic fluid force to motors 19 and 20 to vibrate the tamping tools without the use of an eccenter shaft.

The use of hydraulic drives and the individual control thereof for reciprocating the tamping tools makes possible asynchronous tamping of the ballast to obtain uniform compaction thereof and termination of the tamping in response to a predetermined degree of ballast compaction, as is known. This is of particular advantage in the simultaneous tamping of three successive ties since it assures uniform ballast density over the entire tamped region.

Obviously, the drive for moving pair 5 or 7 of the tamping tools may also take any desired form, the illustrated pinion-and-rack drive being substituted, for instance, by a spindle drive or any other suitable position adjustment means being used.

I claim:

1. A mobile track tamping machine for substantially simultaneously tamping ballast underneath successive track ties resting on the ballast, the ties having elongated edges extending transversely of the track and two ends extending in the direction of the track, the elongated edges of adjacent ones of the ties defining cribs therebetween, which comprises (a) machine frame;

(b) a carrier mounted on the machine frame;

(c) a tamping tool assembly mounted on the carrier and including as sole means for tamping ballast from the cribs under the ties (1) three pairs of vibratory tamping tools spaced from each other in the direction of the track, the spacing being such that each pair of tools is in vertical alignment with a respective one of three successive ones of the cribs whereby a respective pair of the tamping tools may be immersed in the three successive cribs upon vertical lowering of the tamping tool assembly carrier, the tamping tools of each pair being reciprocable in opposite directions towards and away from a respective one of the elongated edges of the ties, the ballast under which is being tamped by the tools of the pair (d) a common drive for vibrating the three pairs of tamping tools, (e) a drive for vertically moving the carrier, (f) drive means for reciprocating the tamping tools of each pair, and (g) means for mounting the pairs of tamping tools on either side of an intermediate one of the pairs of tamping tools movably in the direction of the track in relation to the intermediate pair of tamping tools.

2. The mobile track tamping machine of claim 1, further comprising surface tamper means arranged for compacting the ballast in the crib behind a last one of the pairs of tamping tools in the direction of machine operation.

3. The mobile track tamping machine of claim 1, wherein the common vibrating drive is arranged above and in vertical alignment with the intermediate pair of tamping tools, further comprising respective carrier frames mounting the two pairs of tamping tools on either side thereof on the carrier, and the reciprocating drive means comprising a respective drive linking each of the tamping tools of the intermediate pair to the vibrating drive, and a further respective drive linking each of the carrier frames to the vibrating drive.

4. The mobile track tamping machine of claim 3, the tamping tools of each pair being vibrated by the vibrating drive in opposite directions.

5. The mobile track tamping machine of claim 3, wherein the tamping tools of the two pairs on either side of the intermediate pair of tamping tools include tool holders in the shape of bell crank levers, the fulcrum of each of the tool holders being pivoted to a respective one of the carrier frames, and the reciprocating drive means comprising additional drives linking the tool holders of the two pairs of tamping tools to the respective carrier frames.

6. The mobile track tamping machine of claim 3, wherein the means for mounting the pairs of tamping tools movably comprises guide means on the carrier for mounting each of the carrier frames movably in the direction of the track in relation to the carrier.

7. The mobile track tamping machine of claim 6, further comprising means for holding the carrier frames at an adjusted distance from the intermediate pair of tamping tools.

8. The mobile track tamping machine of claim 1, wherein the tamping tool assembly comprises an additional vibratory tamping tools associated with each of the pairs of tamping tools and arranged for immersion in the ballast adjacent the ends of the ties and for reciprocation in a direction towards and away from the tie ends, each additional tamping tool being mounted behind the associated pair of tamping tools in the direction of machine operation.

* * * * *